US011196163B2

(12) United States Patent
Lee et al.

(10) Patent No.: US 11,196,163 B2
(45) Date of Patent: Dec. 7, 2021

(54) ANTENNA STRUCTURE

(71) Applicant: Chiun Mai Communication Systems, Inc., New Taipei (TW)

(72) Inventors: Cheng-Han Lee, New Taipei (TW); Huo-Ying Chang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 261 days.

(21) Appl. No.: 16/217,068

(22) Filed: Dec. 12, 2018

(65) Prior Publication Data

US 2019/0181555 A1 Jun. 13, 2019

Related U.S. Application Data

(60) Provisional application No. 62/597,442, filed on Dec. 12, 2017, provisional application No. 62/614,364, filed on Jan. 6, 2018.

(51) Int. Cl.

| | |
|---|---|
| ***H01Q 5/35*** | (2015.01) |
| ***H01Q 9/28*** | (2006.01) |
| ***H01Q 3/24*** | (2006.01) |
| ***H01Q 9/42*** | (2006.01) |
| ***H01Q 5/335*** | (2015.01) |
| ***H01Q 21/28*** | (2006.01) |
| ***H01Q 1/24*** | (2006.01) |
| ***H01Q 13/10*** | (2006.01) |
| ***H01Q 9/30*** | (2006.01) |

(52) U.S. Cl.

CPC ..... *H01Q 5/35* (2015.01); *H01Q 1/243* (2013.01); *H01Q 3/247* (2013.01); *H01Q 5/335* (2015.01); *H01Q 9/285* (2013.01); *H01Q 9/30* (2013.01); *H01Q 9/42* (2013.01); *H01Q 13/10* (2013.01); *H01Q 21/28* (2013.01)

(58) Field of Classification Search

CPC ..... H01Q 5/35; H01Q 5/335; H01Q 1/243; H01Q 3/247; H01Q 9/285; H01Q 9/30; H01Q 9/42; H01Q 13/10; H01Q 21/28

See application file for complete search history.

(56) References Cited

U.S. PATENT DOCUMENTS

| | | | | |
|---|---|---|---|---|
| 2012/0009983 | A1* | 1/2012 | Mow | H04B 1/40 455/575.7 |
| 2015/0372372 | A1 | 12/2015 | Lee et al. | |
| 2018/0034135 | A1* | 2/2018 | Kwak | H01Q 9/42 |
| 2018/0358699 | A1 | 12/2018 | Li et al. | |
| 2019/0036210 | A1* | 1/2019 | Kim | H01Q 5/35 |

FOREIGN PATENT DOCUMENTS

| | | | |
|---|---|---|---|
| CN | 104300215 | A | 1/2015 |
| CN | 107317095 | A | * 11/2017 |
| CN | 107317095 | A | 11/2017 |
| WO | 2017/092003 | A1 | 6/2017 |

* cited by examiner

*Primary Examiner* — Andrea Lindgren Baltzell
*Assistant Examiner* — Noel Maldonado
(74) *Attorney, Agent, or Firm* — ScienBiziP, P.C.

(57) ABSTRACT

An antenna structure includes a housing, a first feed source, and a second feed source. The first feed source is electrically coupled to a first radiating portion of the housing and adapted to provide an electric current to the first radiating portion. The second feed source is electrically coupled to one of a second radiating portion or a third radiating portion of the housing. The other one of the second radiating portion or the third radiating portion is electrically coupled to the first radiating portion.

20 Claims, 24 Drawing Sheets

ANTENNA STRUCTURE

FIELD

The subject matter herein generally relates to antenna structures, and more particularly to an antenna structure of a wireless communication device.

BACKGROUND

As electronic devices become smaller, an antenna structure for operating in different communication bands is required to be smaller.

BRIEF DESCRIPTION OF THE DRAWINGS

Implementations of the present disclosure will now be described, by way of embodiments only, with reference to the attached figures.

DETAILED DESCRIPTION

Figure 1:
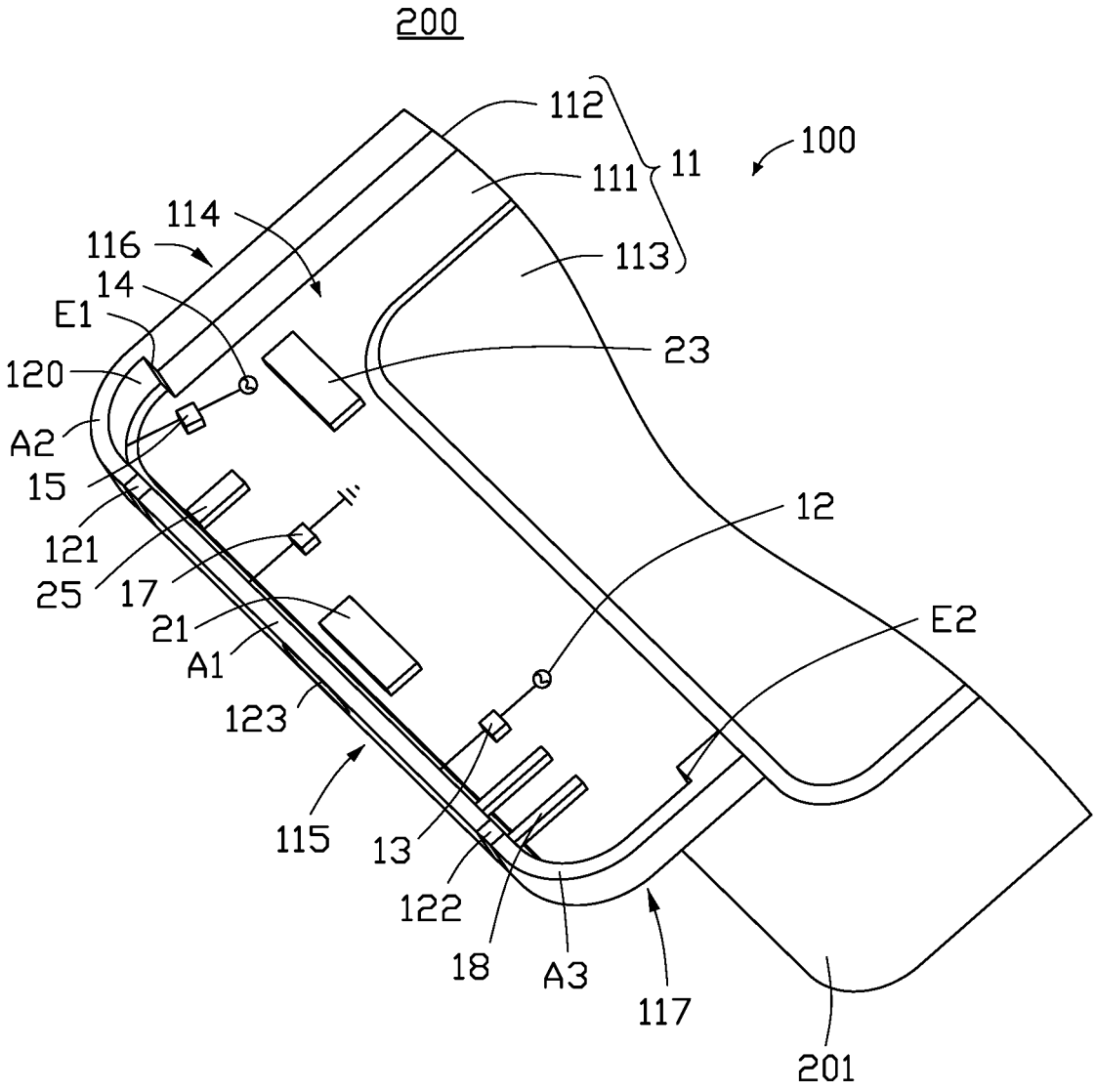
FIG. 1 is a partial isometric view of an embodiment of an antenna structure in a wireless communication device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

Figure 2:
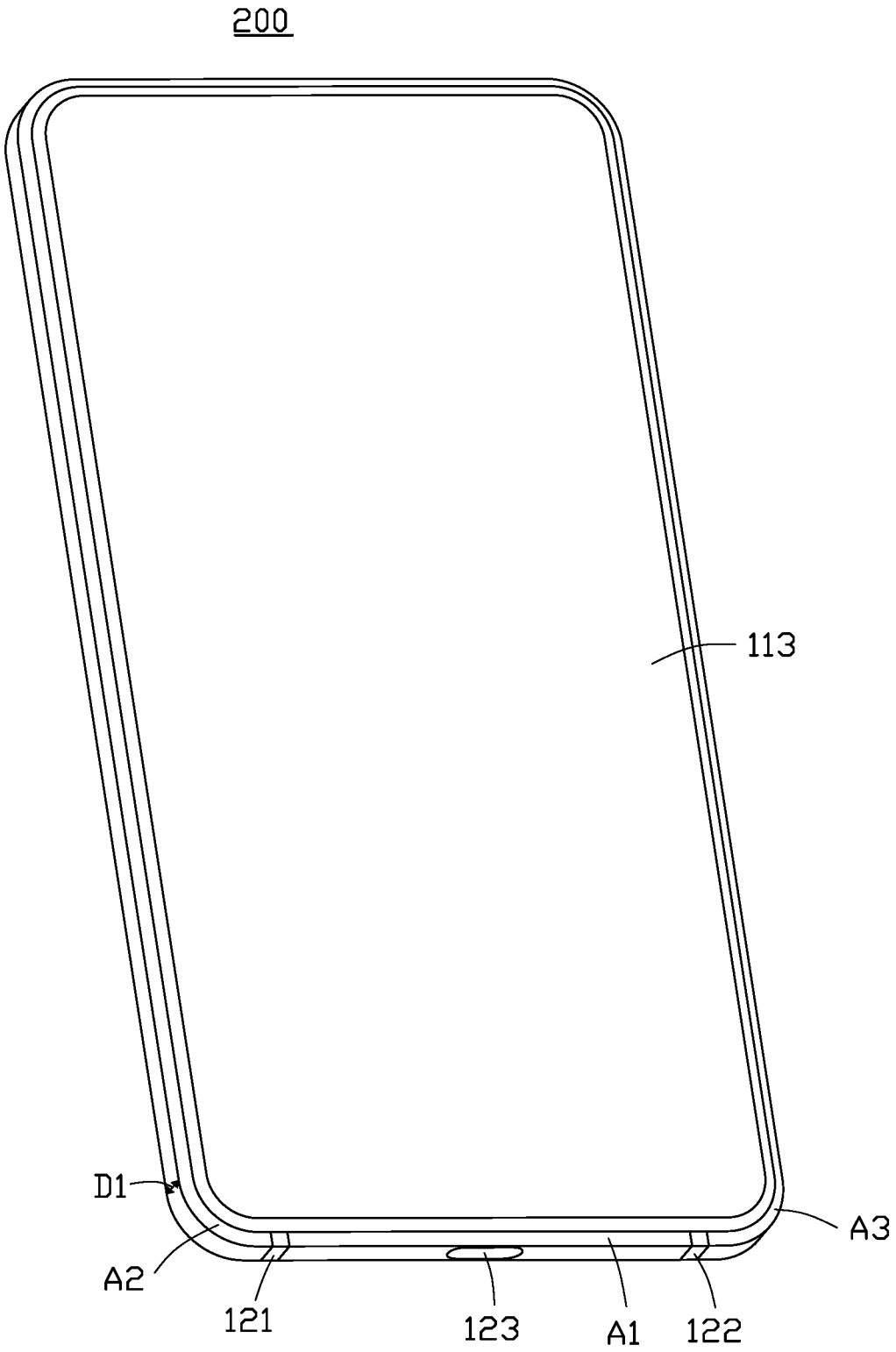
FIG. 2 is an isometric view of the communication device in FIG. 1.

FIG. 1 and FIG. 2 show an embodiment of an antenna structure 100 applicable in a mobile phone, a personal digital assistant, or other wireless communication device 200 for sending and receiving wireless signals.

Figure 3:
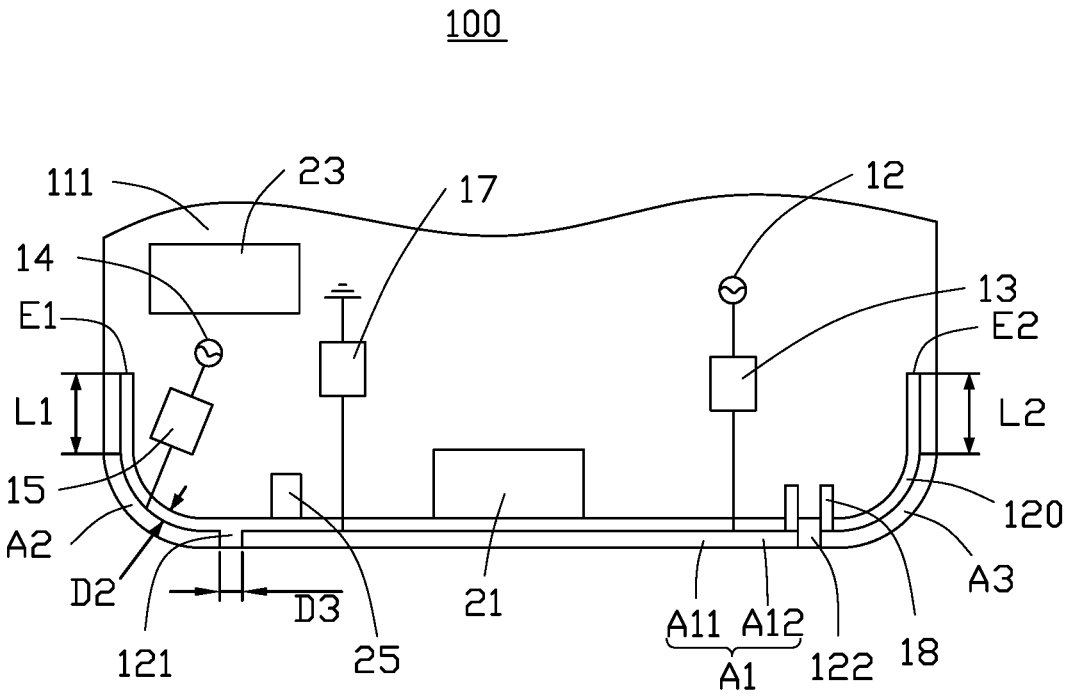
FIG. 3 is a diagram of the antenna structure in FIG. 1.

As shown in FIG. 3, the antenna structure 100 includes a housing 11, a first feed source 12, a first matching circuit 13, a second feed source 14, and a second matching circuit 15.

The housing 11 includes at least a middle frame 111, a border frame 112, and a backplane 113. The middle frame 111 is substantially rectangular. The middle frame 111 is made of metal. The border frame 112 is substantially hollow rectangular and is made of metal. In one embodiment, the border frame 112 is mounted around a periphery of the middle frame 111 and is integrally formed with the middle frame 111. The border frame 112 receives a display 201 mounted opposite the middle frame 111. The middle frame 111 is a metal plate mounted between the display 201 and the backplane 113. The middle frame 111 supports the display 201, provides electromagnetic shielding, and enhances durability of the wireless communication device 200.

The backplane 113 is made of insulating material, such as glass. The backplane 113 is mounted around a periphery of the border frame 112 and is substantially parallel to the display 201 and the middle frame 111. In one embodiment, the backplane 113, the border frame 112, and the middle frame 111 cooperatively define an accommodating space 114. The accommodating space 114 receives components (not shown) of the wireless communication device 200.

The border frame 112 includes at least an end portion 115, a first side portion 116, and a second side portion 117. In one embodiment, the end portion 115 is a bottom end of the wireless communication device 200. The first side portion 116 and the second side portion 117 face to each other and are substantially perpendicular to the end portion 115.

In one embodiment, the border frame 112 includes a slot 120, a first gap 121, and a second gap 122. The slot 120 is substantially U-shaped and is defined in an inner side of the end portion 115. In one embodiment, the slot 120 extends along the end portion 115 and extends toward the first side portion 116 and the second side portion 117. The slot 120 insulates the end portion 115 from the middle frame 111.

In one embodiment, the first gap 121 and the second gap 122 are located on the end portion 115 and are spaced apart. The first gap 121 and the second gap 122 cut across and cut through the border frame 112. The first gap 121 and the second gap 122 are connected to the slot 120. The slot 120, the first gap 121, and the second gap 122 separate the housing 11 into a first radiating portion A1, a second radiating portion A2, and a third radiating portion A3. In one embodiment, the first radiating portion A1 is located between the first gap 121 and the second gap 122, the second radiating portion A2 is a portion of the border frame 112 located between the first gap 121 and an endpoint E1 of the first side portion 116, and the third radiating portion A3 is a portion of the border frame 112 located between the second gap 122 and an endpoint E2 of the second side portion 117. In one embodiment, the first radiating portion A1 is insulated from the middle frame 111. An end of the second radiating portion A2 adjacent the endpoint E1 and an end of the third radiating portion A3 adjacent the endpoint E2 are coupled to the middle frame 111.

In one embodiment, the border frame 112 has a thickness D1. The slot 120 has a width D2. The first gap 121 and the second gap 122 have a width D3. D1 is greater than or equal to 2*D3. D2 is less than or equal to half of D3. In one embodiment, the thickness D1 of the border frame 112 is 2-6 mm, the width D2 of the slot 120 is 0.5-1.5 mm. The width D3 of the first gap 121 and the second gap 122 is 1-3 mm.

In one embodiment, the slot 120, the first gap 121, and the second gap 122 are made of insulating material, such as plastic, rubber, glass, wood, ceramic, or the like.

The wireless communication device 200 further includes at least one electronic component, such as a first electronic component 21, a second electronic component 23, and a third electronic component 25. The first electronic component 21 may be a universal serial bus (USB) port located within the accommodating space 114. The first electronic component 21 is insulated from the first radiating portion A1 by the slot 120. The second electronic component 23 may be a speaker and is mounted corresponding to the first gap 121 and is spaced 4-10 mm from the slot 120. The third electronic component 25 may be a microphone and is mounted within the accommodating space 114. The third electronic component 25 is located between the second electronic component 23 and the slot 120 and is adjacent the second gap 122. In one embodiment, the third electronic component 25 is insulated from the first radiating portion A1 by the slot 120.

In another embodiment, the second electronic component 23 and the third electronic component 25 can be mounted in different locations according to requirements.

In one embodiment, the border frame 112 defines a port 123 in the end portion 115. The port 123 corresponds to the first electronic component 21 so that the first electronic component 21 partially protrudes through the port 123. Thus, a USB device can be inserted in the port 123 to electrically coupled to the first electronic component 21.

In one embodiment, the first feed source 12 and the first matching circuit 13 are received within the accommodating space 114. One end of the first feed source 12 is electrically coupled to a side of the first radiating portion A1 adjacent the second gap 122 through the first matching circuit 13 for feeding a current signal to the first radiating portion A1. The first matching circuit 13 provides a matching impedance between the first feed source 12 and the first radiating portion A1.

In one embodiment, the first feed source 12 divides the first radiating portion A1 into a first radiating section A11 and a second radiating section A12. A portion of the border frame 112 between the first feed source 12 and the first gap 121 is the first radiating section A11. A portion of the border frame 112 between the first feed source 12 and the second gap 122 is the second radiating section A12. In one embodiment, the first feed source 12 is not positioned in the middle of the first radiating portion A1. Thus, a length of the first radiating section A11 may be greater than a length of the second radiating section A12.

In one embodiment, the second feed source 14 and the second matching circuit 15 are received within the accommodating space 114. One end of the second feed source 14 is electrically coupled to a side of the second radiating portion A2 adjacent the first gap 121 through the second matching circuit 15 for feeding a current signal to the second radiating portion A2. The second matching circuit 15 provides a matching impedance between the second feed source 14 and the second radiating portion A2.

Figure 4:
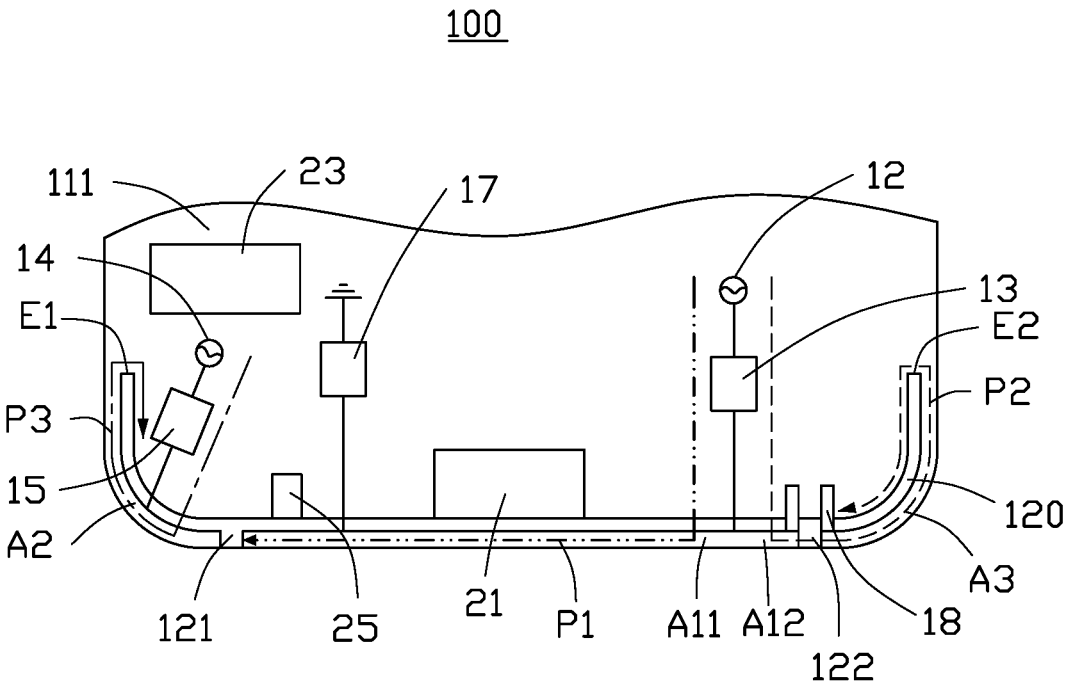
FIG. 4 is a diagram of current paths of the antenna structure in FIG. 3.

As shown in FIG. 4, when the first feed source 12 supplies an electric current, the electric current from the first feed source 12 flows through the first matching circuit 13 and the first radiating section A11 toward the first gap 121 in sequence along a current path P1. Thus, the first antenna section A11 forms a monopole antenna to excite a first resonant mode and generate a radiation signal in a first frequency band.

The electric current from the first feed source 12 can also flow through the first matching circuit 13, the second radiating section A12, and then coupled to the third radiating portion A3 through the second gap 122 along a current path P2. Thus, the first feed source 12, the second radiating section A12, and the third radiating portion A3 form a coupled feed antenna to excite a second resonant mode and generate a radiation signal in a second frequency band.

When the second feed source 14 supplies electric current, the electric current from the second feed source 14 flows through the second matching circuit 15 and the second radiating portion A2 along a current path P3. Thus, the second radiating portion A2 forms a loop antenna to excite a third resonant mode and generate a radiation signal in a third frequency band.

In one embodiment, the first resonant mode is a Long Term Evolution Advanced (LTE-A) low-frequency mode, the second resonant mode is an LTE-A mid-frequency mode, and the third resonant mode is an LTE-A high-frequency mode. The first frequency band is 700-960 MHz. The second frequency band is 1710-2170 MHz. The third frequency band is 2300-2690 MHz.

In one embodiment, electric current from the first feed source 12 flows to the first radiating section A11 to excite the LTE-A low-frequency mode, and the electric current from the first feed source 12 flows through the second radiating section A12 to couple to the third radiating portion A3 to excite the LTE-A mid-frequency mode. Thus, the first radiating portion A1 and the third radiating portion A3 receive electric current from the first feed source 12 to excite the LTE-A low and mid-frequency modes which include the frequencies 700-960 MHz and 1710-2170 MHz.

In one embodiment, a portion of the slot 120 from the endpoint E1 and parallel to the first side portion 116 defines the length L1 of 1-10 mm. A portion of the slot 120 from the endpoint E2 and parallel to the second side portion 117 defines the length L2 of 1-10 mm. The lengths L1 and L2 of the slot 120 are able to adjust the LTE-A middle and high-frequency modes.

As shown in FIG. 3, the antenna structure 100 further includes a switching circuit 17. The switching circuit 17 is mounted within the accommodating space 114 between the first electronic component 21 and the third electronic component 25 adjacent to the third electronic component 25. One end of the switching circuit 17 crosses over the slot 120 and is electrically coupled to a side of the first radiating section A11 adjacent the first gap 121. Another end of the switching circuit 17 is coupled to ground.

Figure 5:
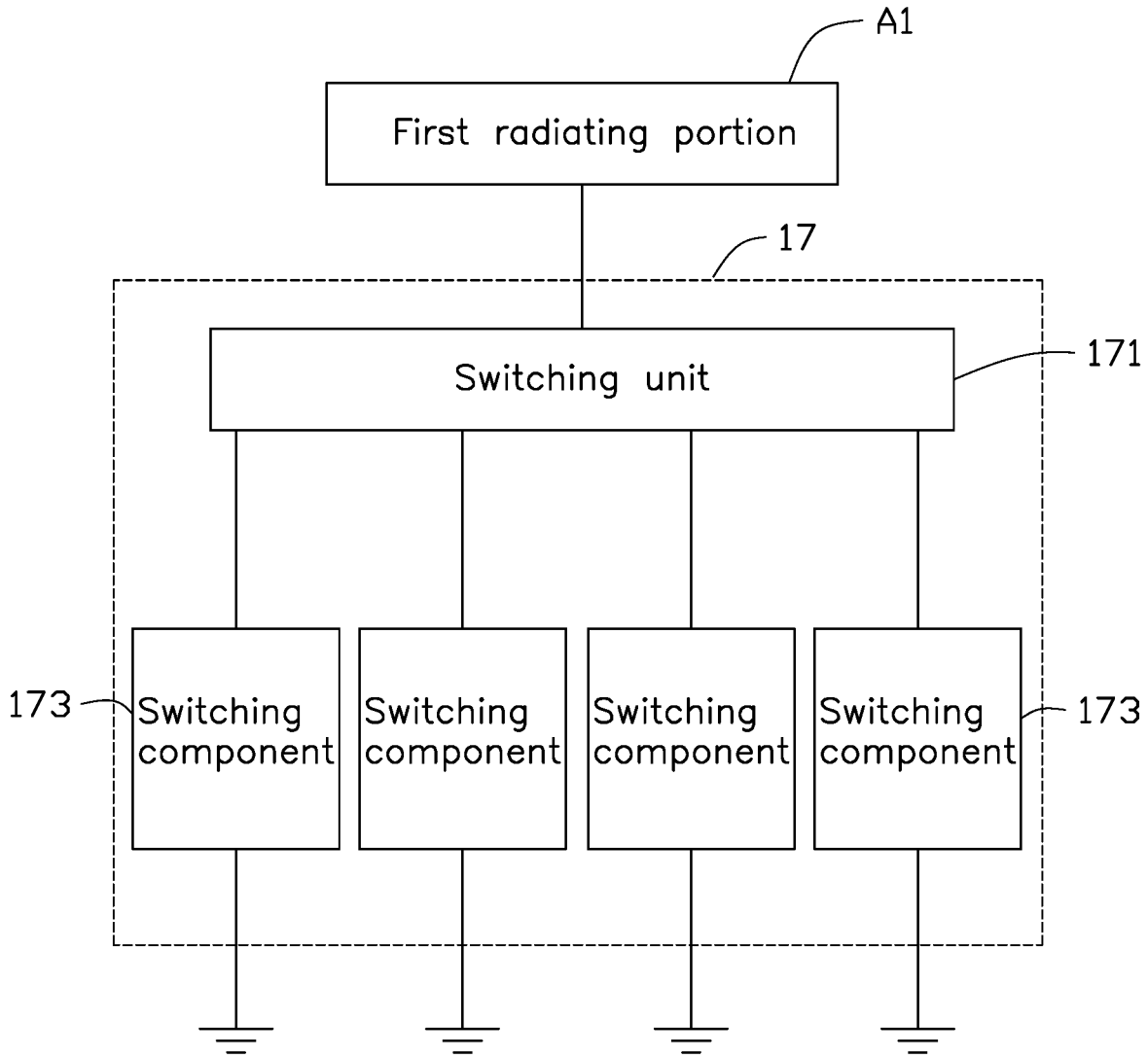
FIG. 5 is a block diagram of a switching circuit.

As shown in FIG. 5, the switching circuit 17 includes a switching unit 171 and at least one switching component 173. The switching unit 171 is electrically coupled to the first radiating section A11. The switching component 173 may be an inductor, a capacitor, or a combination of the two. The switching components 173 are coupled in parallel. One end of each of the at least one switching component 173 is electrically coupled to the switching unit 171, and the other end is coupled to ground. Thus, the first radiating section A11 is switched to electrically coupled to different ones of the switching components 173. Since each of the switching components 173 has a different impedance, the switching components 173 are switched to adjust the LTE-A low-frequency mode.

In one embodiment, the switching circuit 17 includes four different switching components 173. The four different switching components 173 are switched to be coupled to the first radiating section A11 to achieve different LTE-A low-frequency modes, such as LTE-A Band17 (704-746 MHz), LTE-A Band13 (746-787 MHz), LTE-A Band 20 (791-862 MHz), and LTE-A Band8 (880-960 MHz).

The antenna structure 100 further includes at least one extending portion 18. In one embodiment, the antenna structure 100 includes two extending portions 18. The extending portions 18 are made of metal. One of the two extending portions 18 is connected to an end of the second radiating section A12 adjacent to the second gap 122. A second one of the two extending portions 18 is connected to an end of third radiating portion A3 adjacent to the second gap 122. The two extending portions 18 face to each other.

A length and width of the extending portions 18 can be adjusted according to requirements to adjust an impedance value of the first radiating portion A1, the second radiating portion A2, and the third radiating portion A3. The extending portions 18 can replace a ground capacitor of the prior art.

Figure 6:
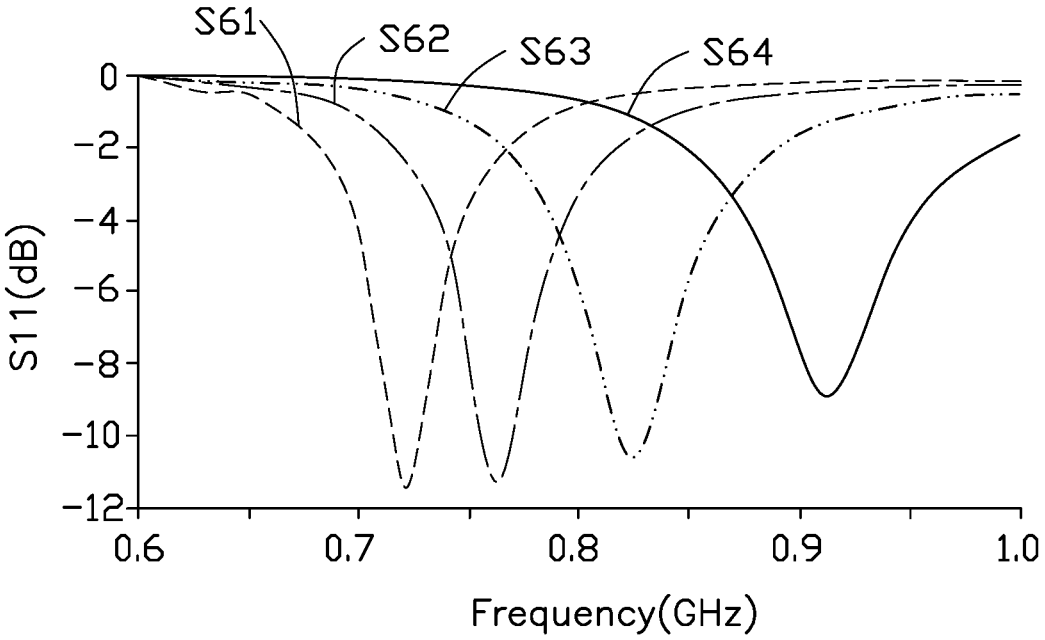
FIG. 6 is a graph of S11 values of an LTE-A low-frequency mode.

FIG. 6 shows a graph of scattering values (S11 values) of the LTE-A low-frequency mode. A plotline S61 represents S11 values of LTE-A Band17 (704-746 MHz). A plotline S62 represents S11 values of LTE-A Band13 (746-787 MHz). A plotline S63 represents S11 values of LTE-A Band17 (791-862 MHz). A plotline S64 represents S11 values of LTE-A Band17 (880-960 MHz).

Figure 7:
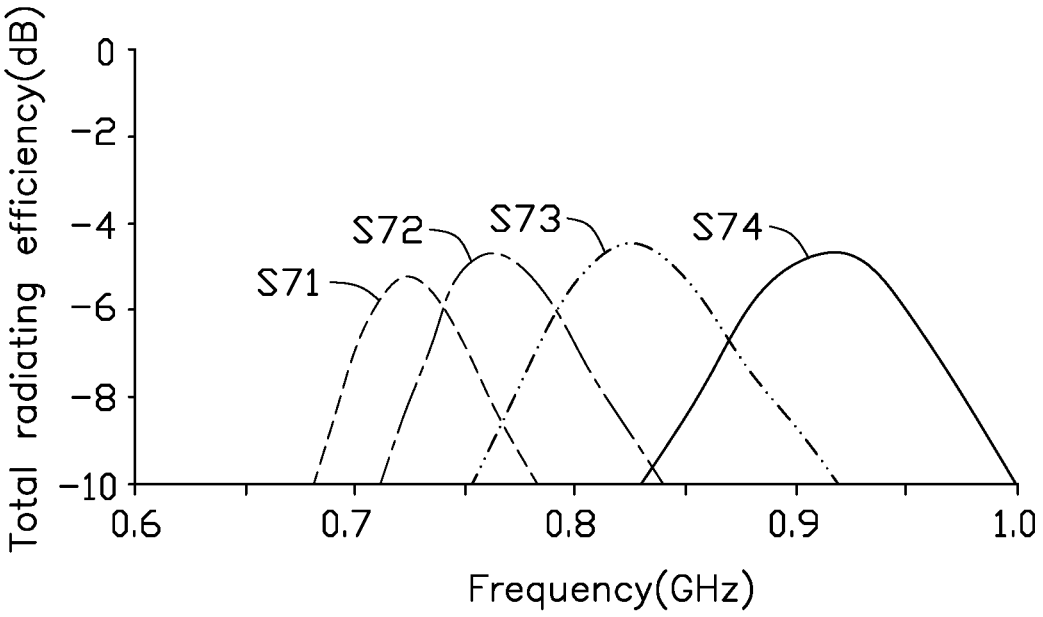
FIG. 7 is a graph of total radiation efficiency of the LTE-A low-frequency mode.

FIG. 7 shows a graph of total radiation efficiency of the LTE-A low-frequency mode. A plotline S71 represents LTE-A Band17 (704-746 MHz). A plotline S72 represents LTE-A Band13 (746-787 MHz). A plotline S73 represents LTE-A Band20 (791-862 MHz). A plotline S74 represents LTE-A Band8 (880-960 MHz).

Figure 8:
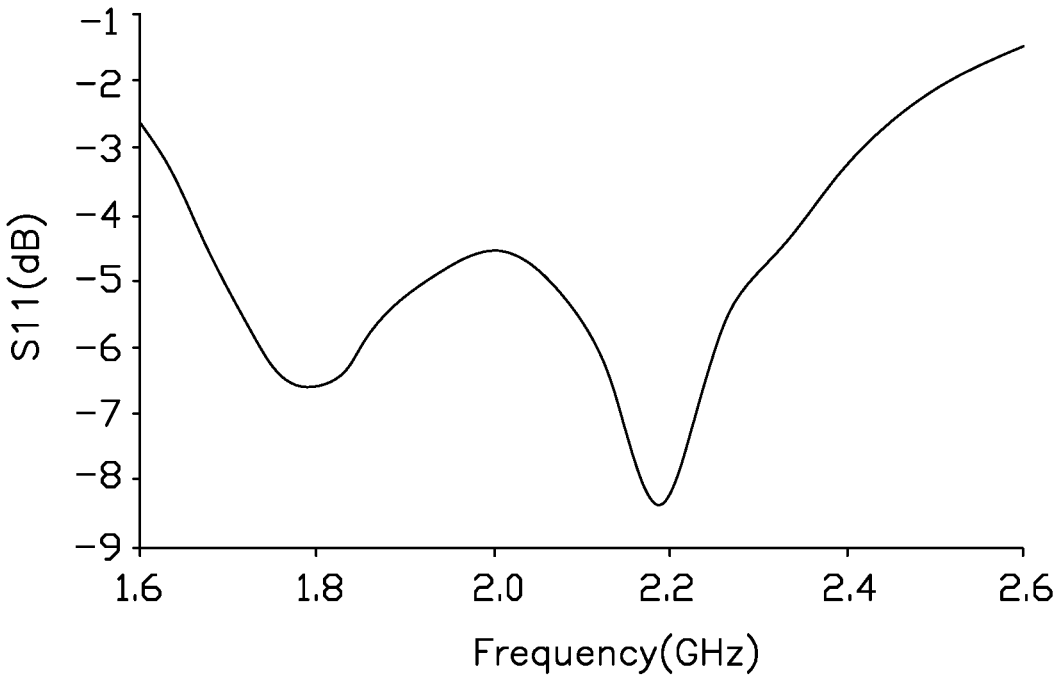
FIG. 8 is a graph of S11 values of an LTE-A mid-frequency mode.

FIG. 8 shows a graph of S11 values of the LTE-A mid-frequency mode.

Figure 9:
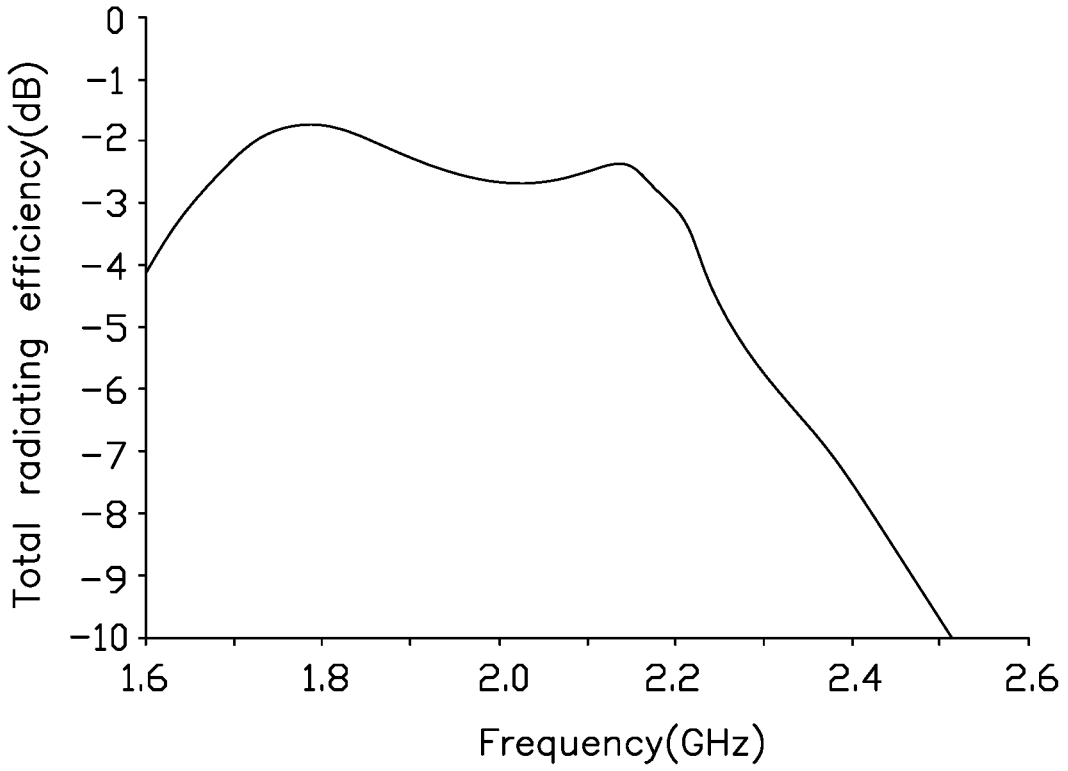
FIG. 9 is a graph of total radiation efficiency of the LTE-A mid-frequency mode.

FIG. 9 shows a graph of total radiation efficiency of the LTE-A mid-frequency mode.

Figure 10:
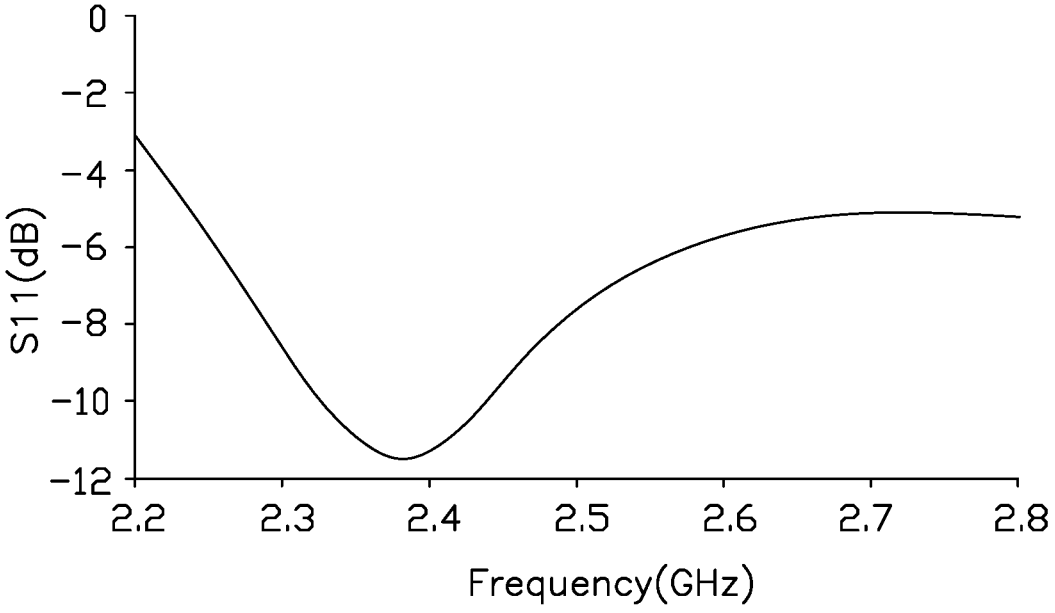
FIG. 10 is a graph of S11 values of an LTE-A high-frequency mode.

FIG. 10 shows a graph of S11 values of the LTE-A high-frequency mode.

Figure 11:
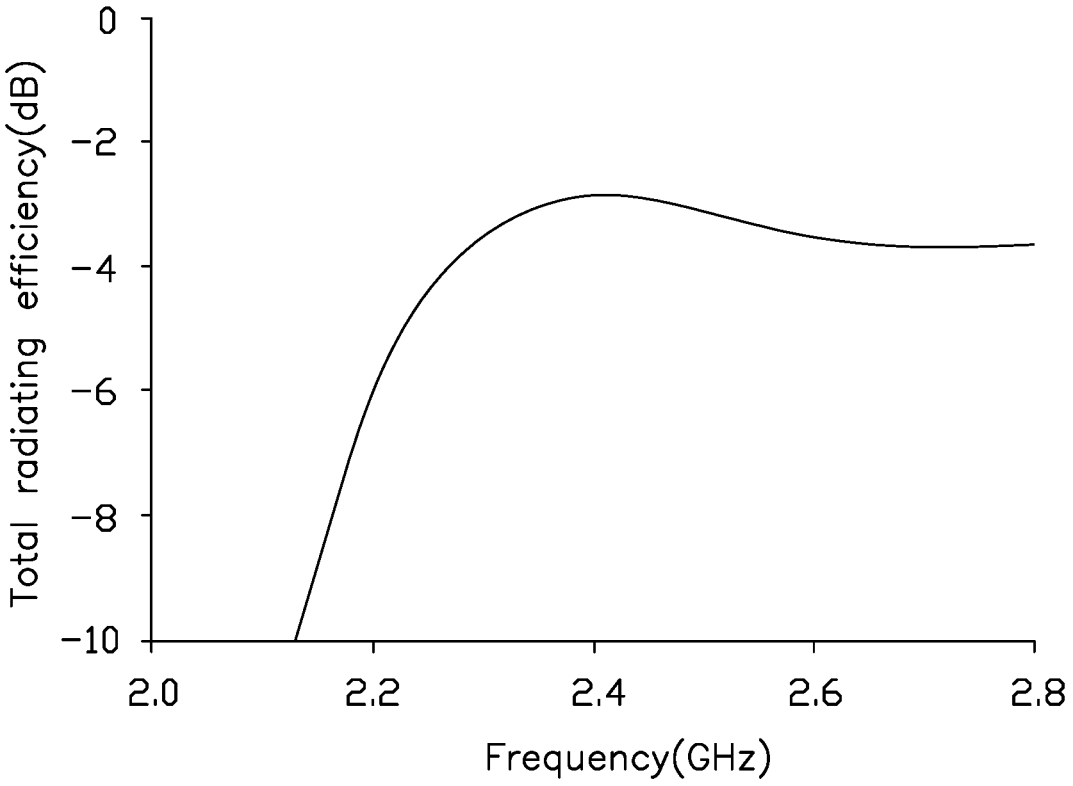
FIG. 11 is a graph of total radiation efficiency of the LTE-A high-frequency mode.

FIG. 11 shows a graph of total radiation efficiency of the LTE-A high-frequency mode.

As shown in FIGS. 8-11, when the antenna structure 100 operates in the LTE-A Band17 (704-746 MHz), LTE-A Band13 (746-787 MHz), LTE-A Band20 (791-862 MHz), and the LTE-A Band8 (880-960 MHz), the LTE-A mid and high-frequency mode range is from 1710-2690 MHz). The switching circuit 17 only adjust the low-frequency mode and does not affect the mid and high-frequency modes.

Figure 12:
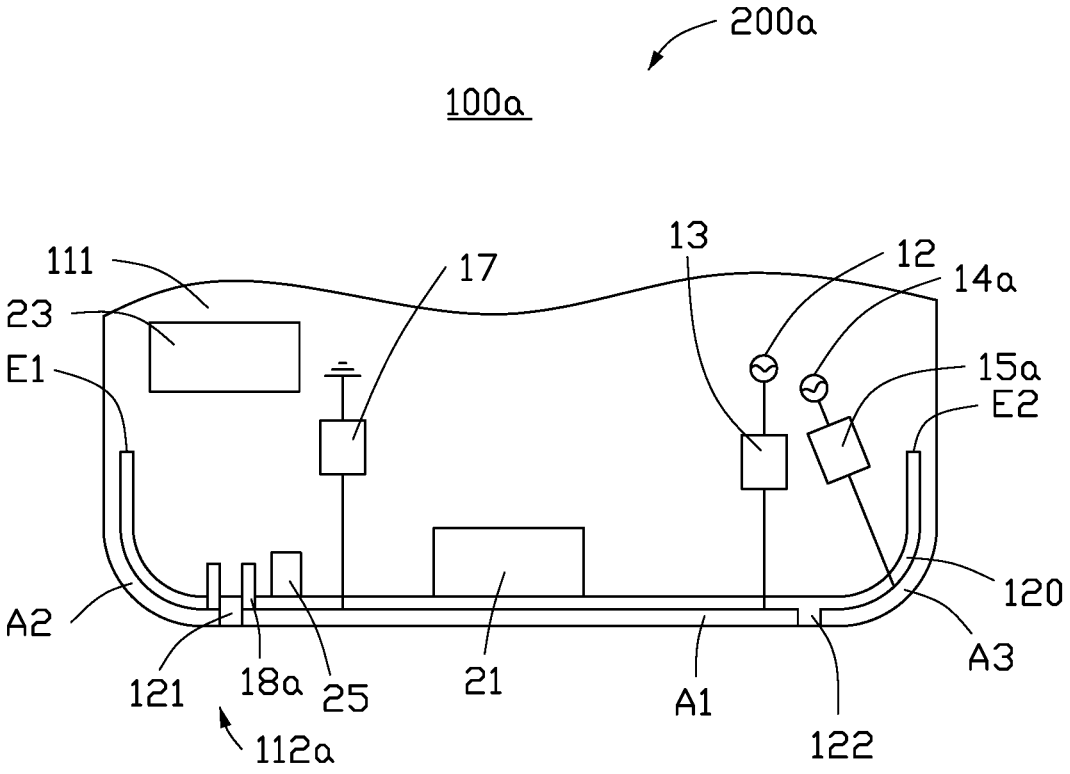
FIG. 12 is a diagram of a second embodiment of an antenna structure.

FIG. 12 shows a second embodiment of an antenna structure 100*a* for use in a wireless communication device 200*a*.

The antenna structure 100*a* includes a middle frame 111, a border frame 112, a first feed source 12, a first matching circuit 13, a second feed source 14*a*, a second matching circuit 15*a*, a switching circuit 17, and at least one extending portion 18*a*. The wireless communication device 200*a* includes a first electronic component 21, a second electronic component 23, and a third electronic component 25. The border frame 112 includes a slot 120, a first gap 121, and a second gap 122. The first gap 121 and the second gap 122 cut across and cut through the border frame 112. The slot 120, the first gap 121, and the second gap 122 separate the housing 11 into a first radiating portion A1, a second radiating portion A2, and a third radiating portion A3.

The first electronic component 21 may be a USB port located within the accommodating space 114. The first electronic component 21 is insulated from the first radiating portion A1 by the slot 120. The second electronic component 23 may be a speaker and is mounted corresponding to the first gap 121 and is spaced 4-10 mm from the slot 120. The third electronic component 25 may be a microphone and is mounted within the accommodating space 114. The third electronic component 25 is located between the second electronic component 23 and the slot 120 and is adjacent the second gap 122. In one embodiment, the third electronic component 25 is insulated from the first radiating portion A1 by the slot 120.

One end of the first feed source 12 is electrically coupled to a side of the first radiating portion A1 adjacent the second gap 122 through the first matching circuit 13 for feeding a current signal to the first radiating portion A1. The first matching circuit 13 provides a matching impedance between the first feed source 12 and the first radiating portion A1.

One end of the switching circuit 17 is electrically coupled to a side of the first radiating portion A1 adjacent the first gap 121. Another end of the switching circuit 17 is coupled to ground.

Figure 13:
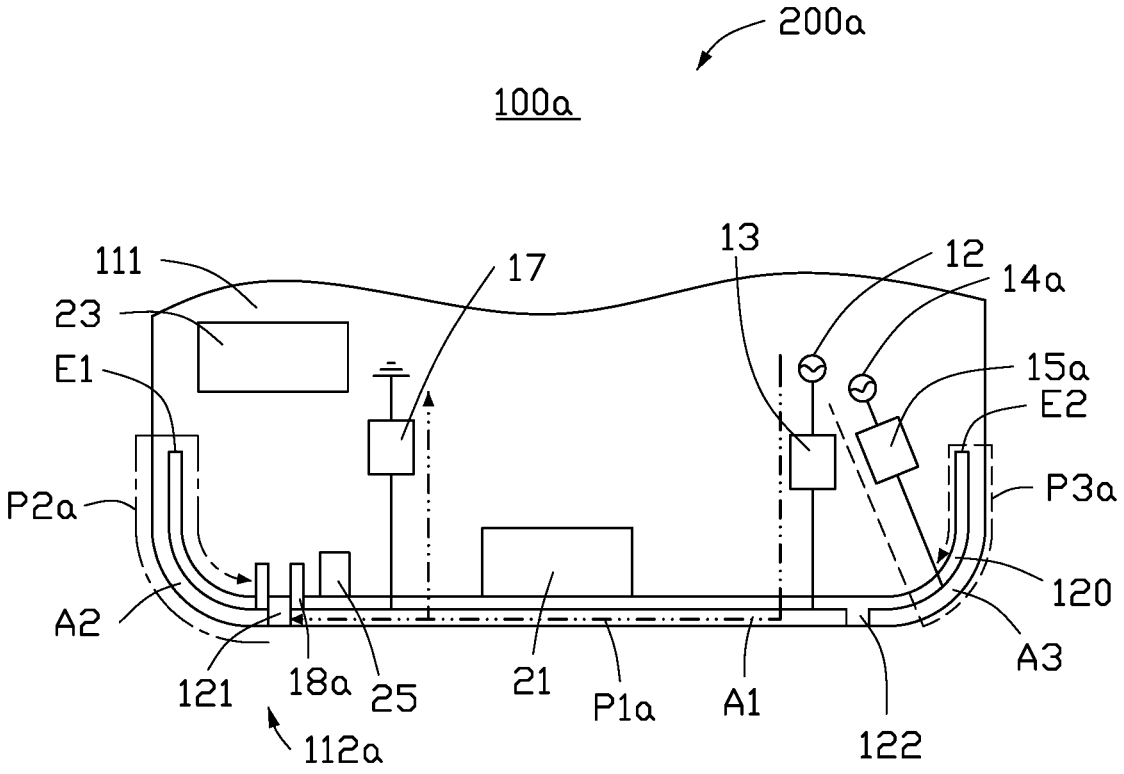
FIG. 13 is a diagram of current paths of the antenna structure in FIG. 12.

A difference between the antenna structure 100*a* and the antenna structure 100 is that in the antenna structure 100*a*, a location of a second feed source 14*a* and a second matching circuit 15*a* is different. Specifically, as shown in FIG. 13, when the first feed source 12 supplies the electric current, the electric current from the first feed source 12 flows through the first matching circuit 13 and the first radiating portion A1, and then flows toward the first gap 121 and flows through the switching circuit 17 to ground along a circuit path P1*a*. Thus, the first radiating portion A1 forms a monopole antenna to excite a first resonant mode and generate a radiation signal in a first frequency band.

Electric current from the first feed source 12 can also flow along a current path P2*a* through the first matching circuit 13 and the first radiating portion A1, and then couple to the second radiating portion A2 through the first gap 121. Thus, the first feed source 12, the first radiating portion A1, and the second radiating portion A2 form a coupled feed antenna to excite a second resonant mode and generate a radiation signal in a second frequency band.

When the second feed source 14*a* supplies electric current, electric current from the second feed source 14*a* flows through the second matching circuit 15*a* and the third radiating portion A3 along a current path P3*a*. Thus, the third radiating portion A3 forms a loop antenna to excite a third resonant mode and generate a radiation signal in a third frequency band.

In one embodiment, the first resonant mode is a Long Term Evolution Advanced (LTE-A) low-frequency mode, the second resonant mode is an LTE-A mid-frequency mode, and the third resonant mode is an LTE-A high-frequency mode. The first frequency band is 700-960 MHz. The second frequency band is 1710-2170 MHz. The third frequency band is 2300-2690 MHz.

Another difference between the antenna structure 100*a* and the antenna structure 100 is that a location of extending portions 18*a* is different. The antenna structure 100*a* includes two extending portions 18*a* made of metal. One of the extending portions 18*a* is mounted to the first radiating portion A1 adjacent an end of the first gap 121, and the other one of the extending portions 18*a* is mounted to the second radiating portion A2 adjacent the other end of the first gap 121.

A length and width of the extending portions 18*a* can be adjusted according to requirements thereby adjusting an impedance value of the first radiating portion A1, the second radiating portion A2, and the third radiating portion A3. The extending portions 18*a* can replace a ground capacitor of the prior art.

Figure 14:
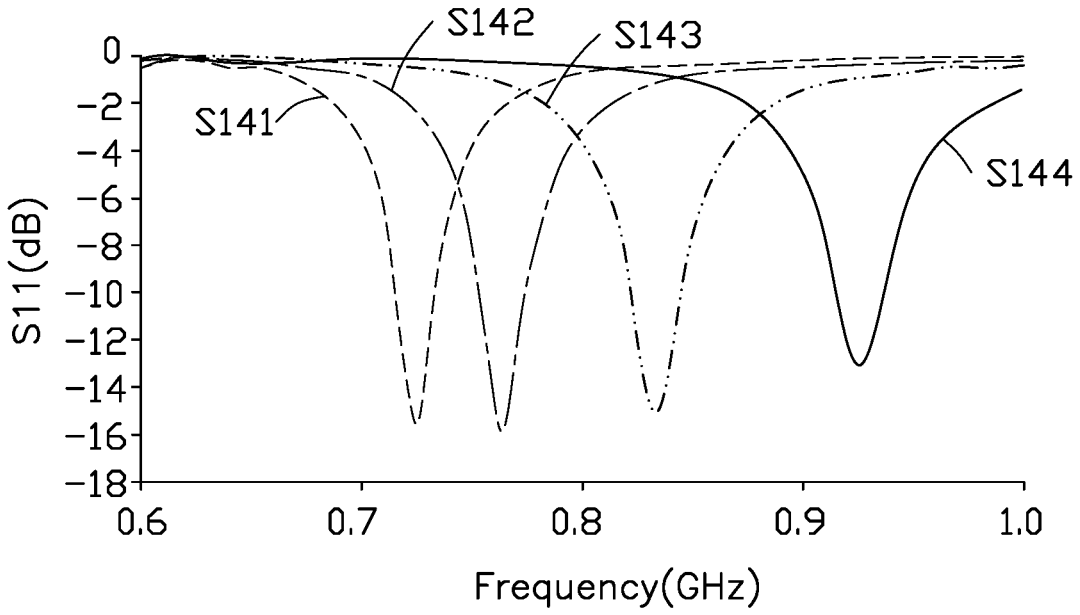
FIG. 14 is a graph of S11 values of the LTE-A low-frequency mode.

FIG. 14 shows a graph of scattering values (S11 values) of the LTE-A low-frequency mode. A plotline S141 represents S11 values of LTE-A Band17 (704-746 MHz). A plotline S142 represents S11 values of LTE-A Band13 (746-787 MHz). A plotline S143 represents S11 values of LTE-A Band20 (791-862 MHz). A plotline S144 represents S11 values of LTE-A Band8 (880-960 MHz).

Figure 15:
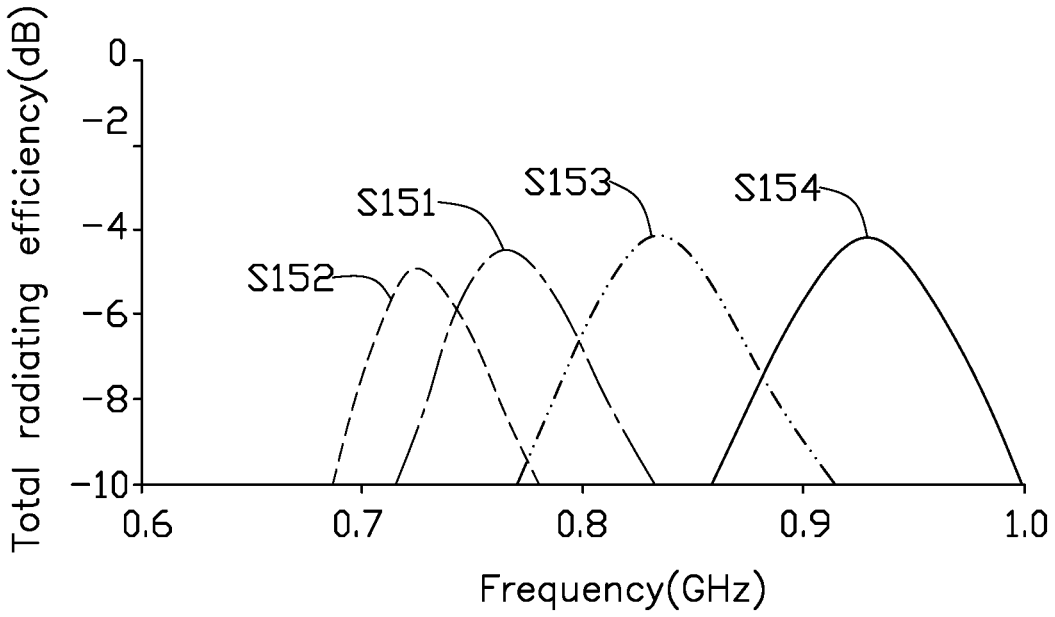
FIG. 15 is a graph of total radiation efficiency of the LTE-A low-frequency mode.

FIG. 15 shows a graph of total radiation efficiency of the LTE-A low-frequency mode. A plotline S151 represents LTE-A Band17 (704-746 MHz). A plotline S152 represents LTE-A Band13 (746-787 MHz). A plotline S153 represents LTE-A Band20 (791-862 MHz). A plotline S154 represents LTE-A Band8 (880-960 MHz).

Figure 16:
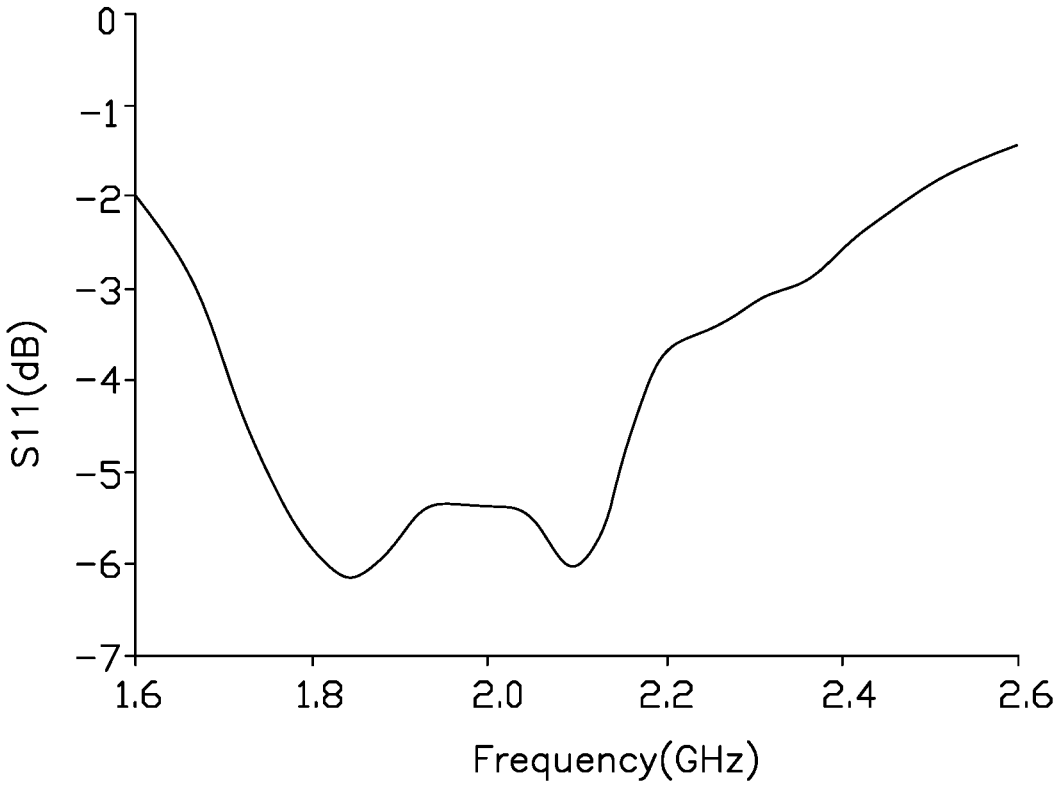
FIG. 16 is a graph of S11 values of a LTE-A mid-frequency mode.

FIG. 16 shows a graph of S11 values of the LTE-A mid-frequency mode.

Figure 17:
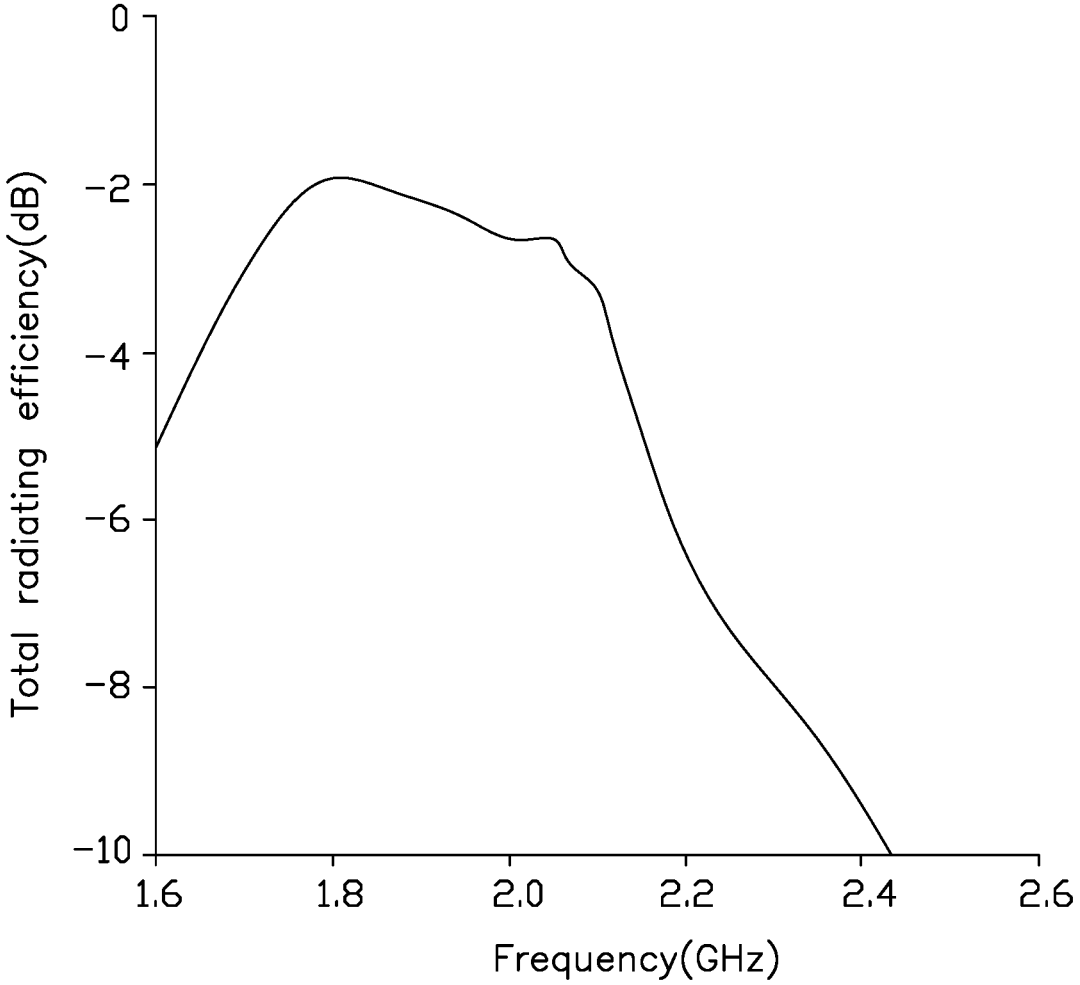
FIG. 17 is a graph of total radiation efficiency of the LTE-A mid-frequency mode.

FIG. 17 shows a graph of total radiation efficiency of the LTE-A mid-frequency mode.

Figure 18:
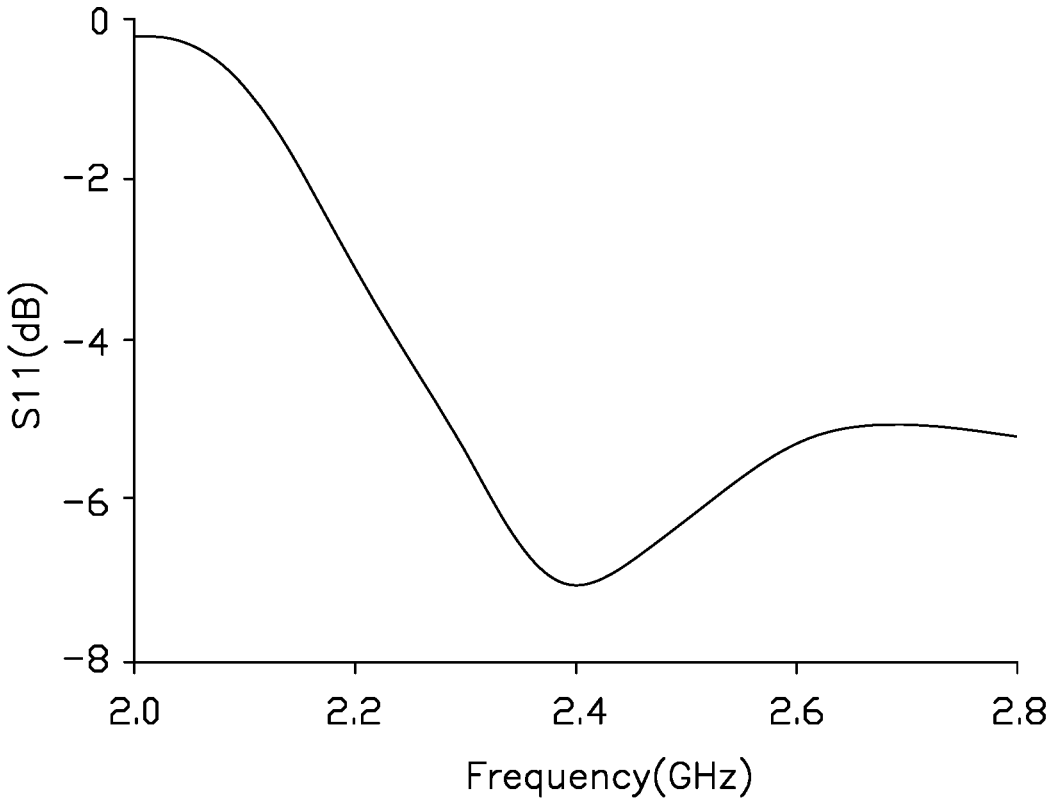
FIG. 18 is a graph of S11 values of a LTE-A high-frequency mode.

FIG. 18 shows a graph of S11 values of the LTE-A high-frequency mode.

Figure 19:
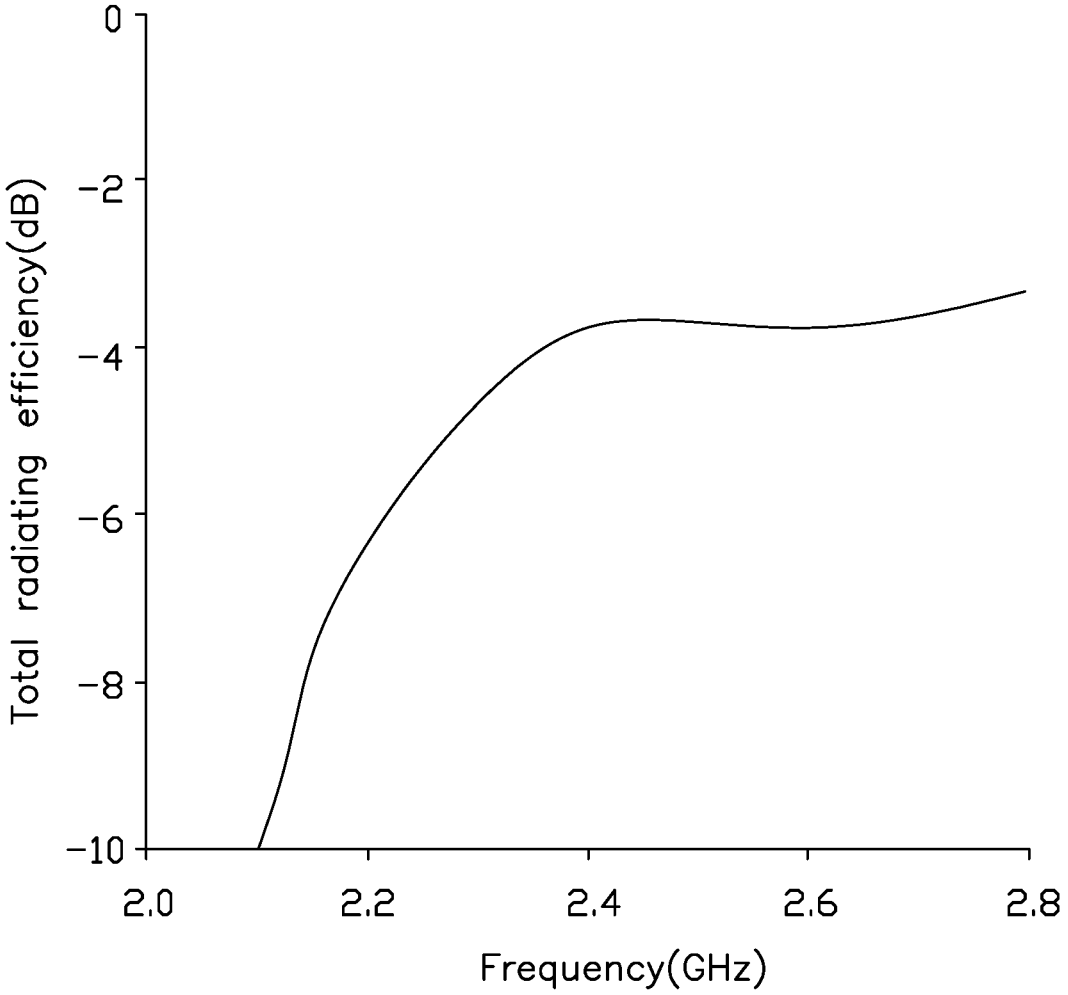
FIG. 19 is a graph of total radiation efficiency of the LTE-A high-frequency mode.

FIG. 19 shows a graph of total radiation efficiency of the LTE-A high-frequency mode.

As shown in FIGS. 14 and 15, the low-frequency mode is excited by the first radiating portion A1, and the switching circuit 17 adjusts the low-frequency mode to include the LTE-A Band17, the LTE-A Band13, the LTE-A Band20, and the LTE-A Band8. As shown in FIGS. 16 and 17, the mid-frequency mode is excited by the second radiating portion A2 and includes LTE-A 1710-2170 MHz. As shown in FIGS. 18 and 19, the high-frequency mode is excited by the third radiating portion A3 and includes LTE-A 2300-2690 MHz.

The switching circuit 17 only adjusts the low-frequency mode to operate within LTE-A Band17, LTE-A Band13, LTE-A Band20, or LTE-A Band8. The switching circuit 17 does not affect operation of the mid and high-frequency modes.

Figure 20:
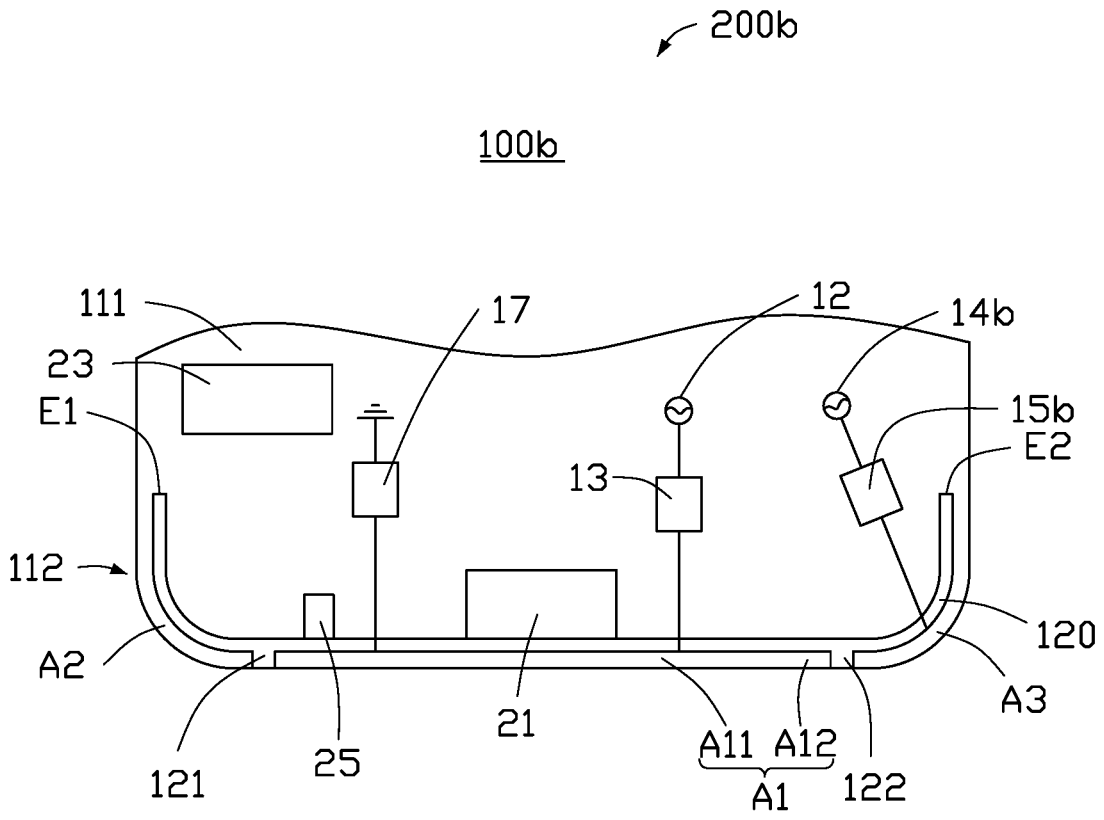
FIG. 20 is a diagram of a third embodiment of an antenna structure.

FIG. 20 shows a third embodiment of an antenna structure 100*b*.

The antenna structure 100*b* includes a middle frame 111, a border frame 112, a first feed source 12, a first matching circuit 13, a second feed source 14*a*, a second matching circuit 15*a*, a switching circuit 17, and at least one extending portion 18*a*. The wireless communication device 200*a* includes a first electronic component 21, a second electronic component 23, and a third electronic component 25.

The border frame 112 includes a slot 120, a first gap 121, and a second gap 122. The first gap 121 and the second gap 122 cut across and cut through the border frame 112. The slot 120, the first gap 121, and the second gap 122 separate the housing 11 into a first radiating portion A1, a second radiating portion A2, and a third radiating portion A3.

The first electronic component 21 may be a USB port located within the accommodating space 114. The first electronic component 21 is insulated from the first radiating portion A1 by the slot 120. The second electronic component 23 may be a speaker and is mounted corresponding to the first gap 121 and is spaced 4-10 mm from the slot 120. The third electronic component 25 may be a microphone and is mounted within the accommodating space 114. The third electronic component 25 is located between the second electronic component 23 and the slot 120 and is adjacent the second gap 122. In one embodiment, the third electronic component 25 is insulated from the first radiating portion A1 by the slot 120.

One end of the first feed source 12 is electrically coupled to a side of the first radiating portion A1 adjacent the second gap 122 through the first matching circuit 13 for feeding a current signal to the first radiating portion A1. The first matching circuit 13 provides a matching impedance between the first feed source 12 and the first radiating portion A1.

In one embodiment, the first feed source 12 divides the first radiating portion A1 into a first radiating section A11 and a second radiating section A12. A portion of the border frame 112 between the first feed source 12 and the first gap 121 forms the first radiating section A11, and a portion of the border frame 112 between the first feed source 12 and the second gap 122 forms the second radiating section A12. In one embodiment, the first feed source 12 is not positioned in the middle of the first radiating portion A1. Thus, a length of the first radiating section A11 may be greater than a length of the second radiating section A12.

One end of the switching circuit 17 is electrically coupled to a side of the first radiating section A11 adjacent the first gap 121. Another end of the switching circuit 17 is coupled to ground.

A difference between the antenna structure 100*b* and the antenna structure 100 is that in the antenna structure 100*b*, locations of a second feed source 14*b* and a second matching circuit 15*b* are different. Specifically, the second feed source 14*b* is not adjacent to the first gap 121 and is not electrically coupled to the second radiating portion A2. In one embodiment, one end of the second feed source 14*b* is electrically coupled to a side of the third radiating portion A3 adjacent to the second gap 122 through the second matching circuit 15*b* to feed a current signal to the third radiating portion A3. The second matching circuit 15*b* provides a matching impedance between the second feed source 14*b* and the third radiating portion A3.

In one embodiment, the extending portion 18 are omitted from the antenna structure 100*b*.

Figure 21:
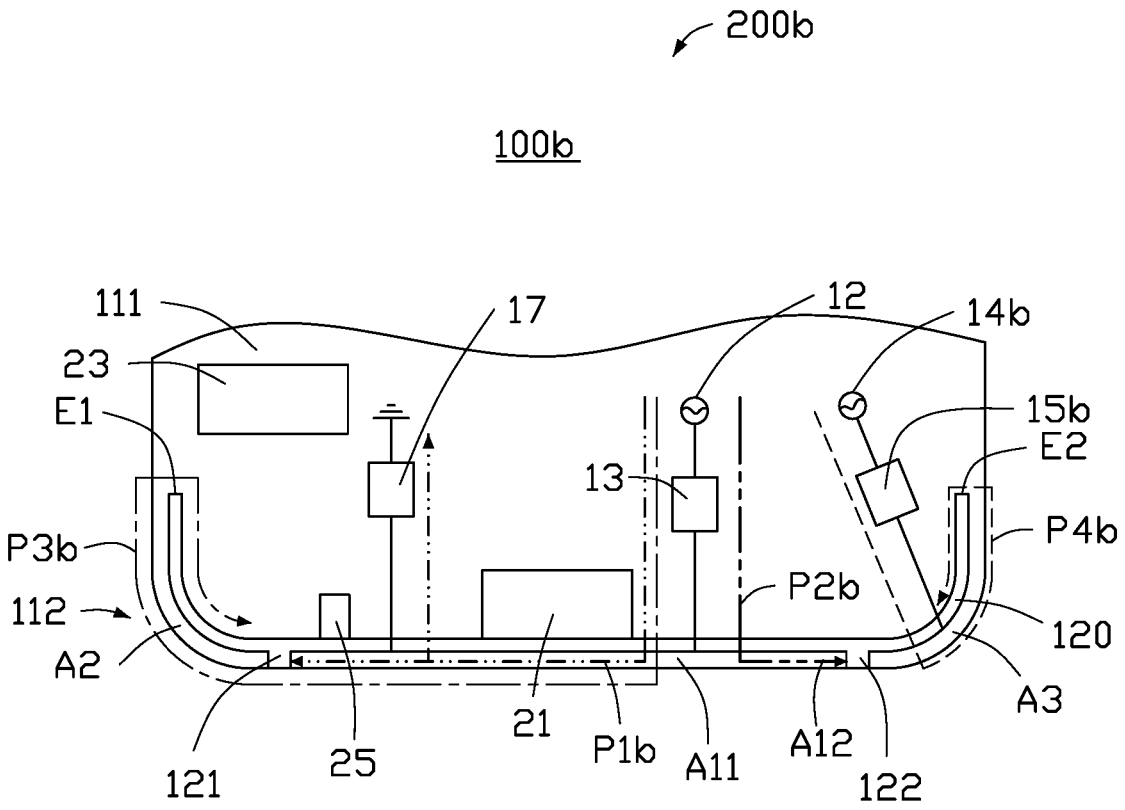
FIG. 21 is a diagram of current paths of the antenna structure in FIG. 20.

As shown in FIG. 21, when the first feed source 12 supplies electric current, the electric current from the first feed source 12 flows through the first matching circuit 13 and the first radiating section A11, and then flows toward the first gap 121 and flows through the switching circuit 17 to ground along a circuit path P1*b*. Thus, the first radiating section A11 forms a monopole antenna to excite a first resonant mode and generate a radiation signal in a first frequency band.

Electric current from the first feed source 12 can also flow along a current path P2*b* through the first matching circuit 13 and the second radiating section A12, and then to the second gap 122 to excite a second resonant mode and generate a radiation signal in a second frequency band. In addition, electric current from the first feed source 12 flows through the first matching circuit 13 and the first radiating section A11, and then flows to the second radiating portion A2 through the first gap 121 along a path P3*b* to excite a third resonant mode and generate a radiation signal in a third frequency band.

When the second feed source 14*b* supplies electric current, the electric current from the second feed source 14*b* flows through the second matching circuit 15*b* and the third radiating portion A3 along a current path P4*b*. Thus, the third radiating portion A3 forms a loop antenna to excite a fourth resonant mode and generate a radiation signal in a fourth frequency band.

In one embodiment, the first resonant mode is a Long Term Evolution Advanced (LTE-A) low-frequency mode, the second resonant mode is an LTE-A mid-frequency mode, the third resonant mode is an LTE-A high-frequency mode, and the fourth resonant mode is an LTE-A mid-high-frequency mode. The first frequency band is 700-960 MHz. The second frequency band is 1710-2170 MHz. The third frequency band is 2300-2690 MHz. The fourth frequency band is 1710-2170 MHz and 2300-2690 MHz.

The antenna structure 100*b* forms a multiple-input multiple-output (MIMO) antenna structure to excite two groups of LTE-A mid and high-frequency modes. Electric current from the first feed source 12 flows to the first radiating portion A1 and is coupled to the second radiating portion A2 to excite a first group of LTE-A low, mid, and high-frequency modes. In addition, electric current from the second feed source 14*b* flows to the third radiating portion A3 to excite a second group of LTE-A mid and high-frequency modes. Thus, the first feed source 12, the first radiating portion A1, and the second radiating portion A2 cooperatively form a first antenna to excite the LTE-A low, mid, and high-frequency modes. The second feed source 14*b* and the third radiating portion A3 cooperatively form a second antenna to excite a second group of LTE-A mid and high-frequency modes.

Figure 22:
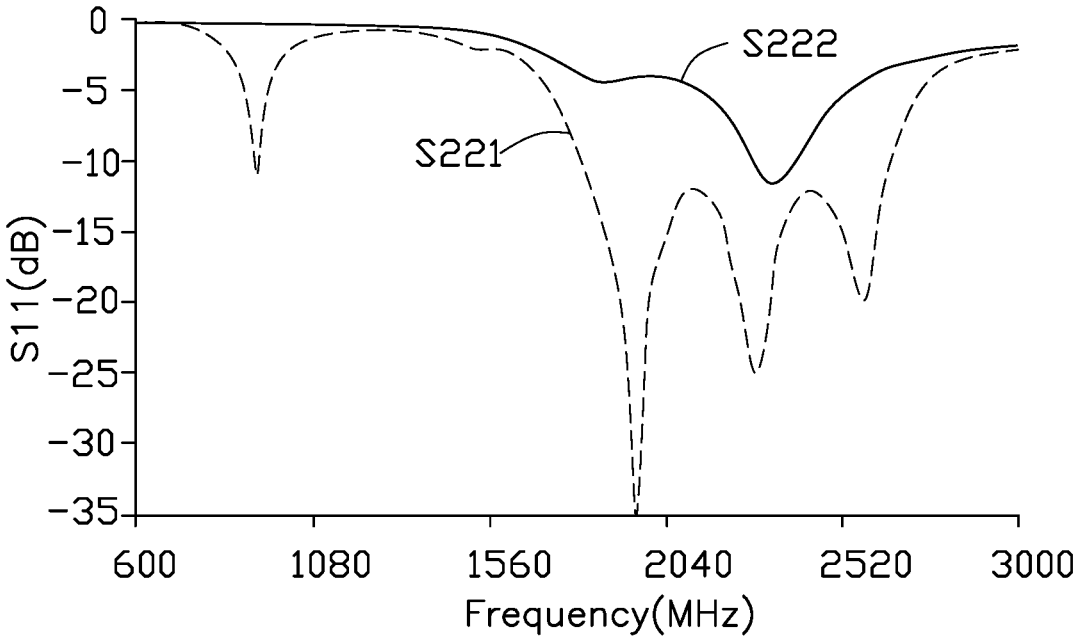
FIG. 22 is a graph of S11 values of a LTE-A low-frequency mode.

FIG. 22 shows a graph of scattering values (S11 values) of the LTE-A low-frequency mode. A plotline S221 represents S11 values of the first antenna. A plotline S222 represents S11 values of the second antenna.

Figure 23:
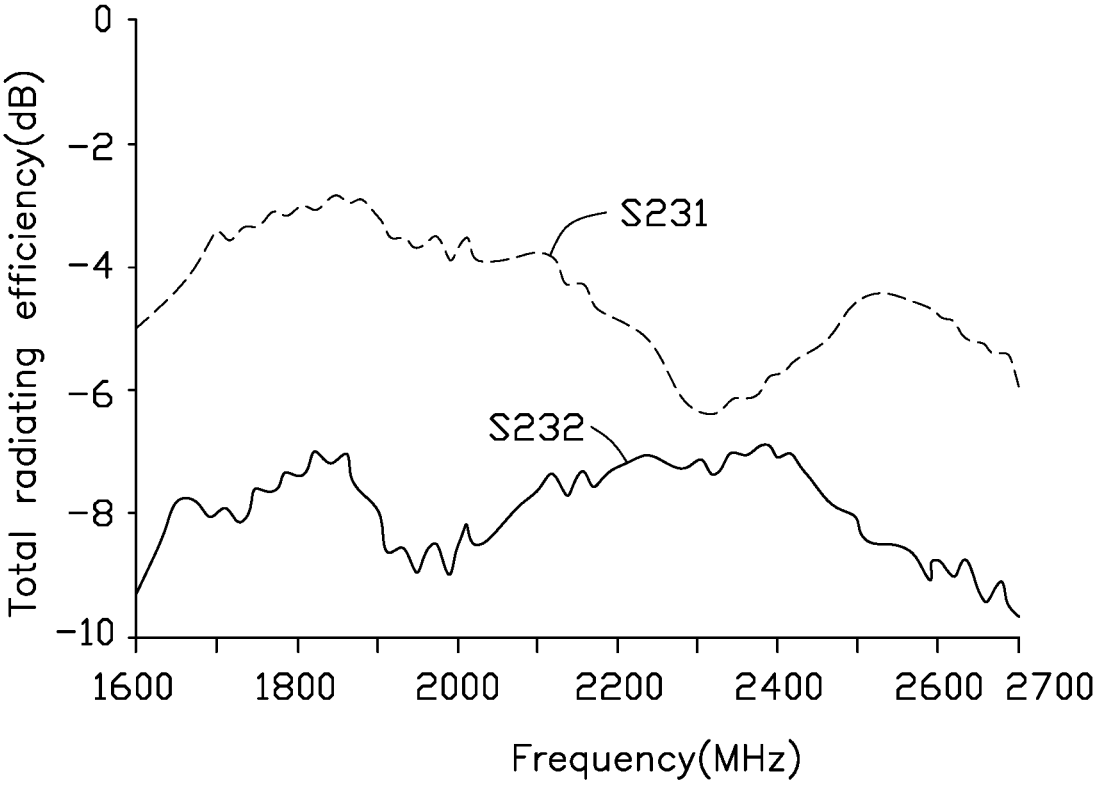
FIG. 23 is a graph of total radiation efficiency of LTE-A mid and high-frequency modes.

FIG. 23 shows a graph of total radiation efficiency of the LTE-A mid and high-frequency modes. A plotline S231 represents LTE-A mid and high-frequency mode of the first antenna. A plotline S232 represents a total radiation efficiency of the second antenna.

Figure 24:
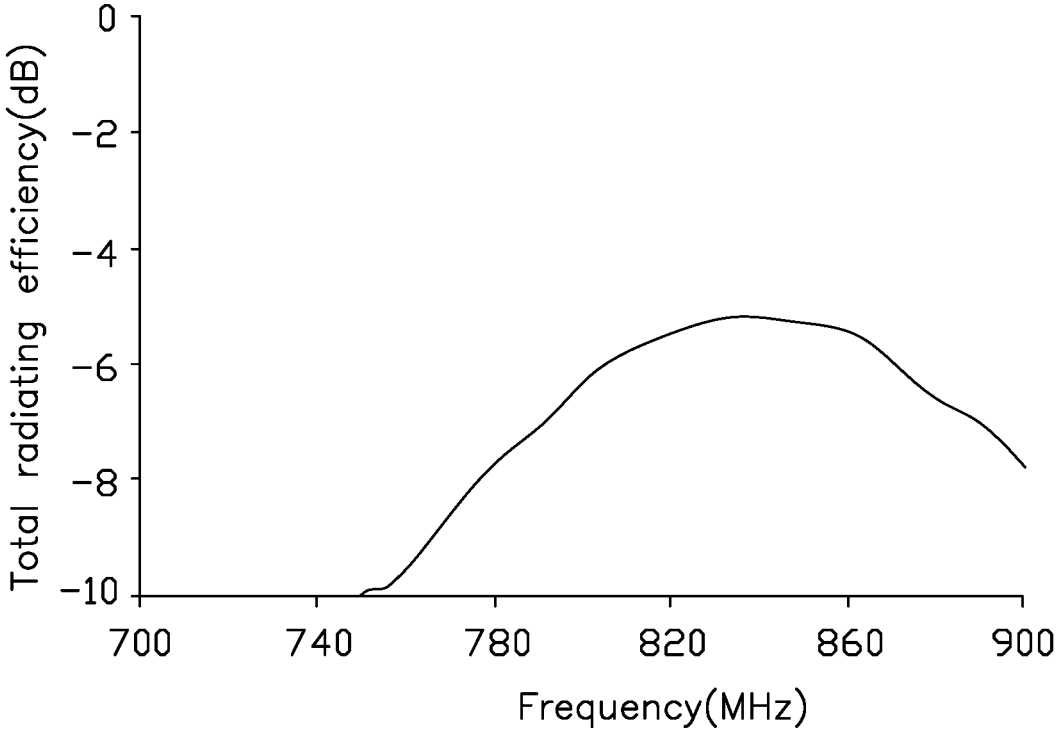
FIG. 24 is a graph of total radiation efficiency of the LTE-A low-frequency mode of a first antenna of the antenna structure.

FIG. 24 shows a graph of total radiation efficiency of the LTE-A low-frequency mode of the first antenna.

As shown in FIGS. 22-24, the low-frequency mode is excited by the first antenna, and the switching circuit 17 adjusts the low-frequency mode to include the LTE-A Band17, the LTE-A Band13, the LTE-A Band20, and the LTE-A Band8. The first antenna and the second antenna of the antenna structure 100*b* both are capable of activating the LTE-A mid and high-frequency modes (1710-2690 MHz).

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a housing comprising a middle frame and a border frame, wherein the middle frame and the border frame are made of metal, the border frame is mounted around a periphery of the middle frame, the border frame comprises a slot, a first gap, and a second gap, the slot is in an inner side of the border frame, a width of a first portion of the border frame defining the slot is less than a width of a second portion of the border frame not defining the slot, the first gap and the second gap are in the border frame, the slot, the first gap, and the second gap divide the border frame into a first radiating portion, a second radiating portion, and a third radiating portion, the first radiating portion is insulated from the middle frame by the slot;

a first feed source electrically coupled to the first radiating portion and adapted to provide an electric current to the first radiating portion;

a second feed source electrically coupled to one of the second radiating portion and the third radiating portion, another one of the second radiating portion and the third radiating portion being electrically coupled to the first radiating portion; and two extending portions, wherein the two extending portions face to each other, the two extending portions are electrically coupled to two radiating portions adjacent to one of the first gap and the second gap; wherein:

a thickness of the border frame is greater than or equal to twice a width of the first gap or twice a width of the second gap; and a width of the slot is less than or equal to half the width of the first gap or half the width of the second gap.

2. The antenna structure of claim 1, wherein:

the border frame comprises an end portion, a first side portion, and a second side portion;

the first side portion and the second side portion are respectively coupled to opposite ends of the end portion;

the first gap is in the end portion adjacent the first side portion, and the second gap is in the end portion adjacent the second side portion;

the slot is in an inner side of the end portion and extends toward the first side portion and the second side portion;

the first radiating portion is defined in a portion of the border frame between the first gap and the second gap;

the second radiating portion is defined in a portion of the border frame between the first gap and an endpoint of the first side portion;

the third radiating portion is defined in a portion of the border frame between the second gap and an endpoint of the second side portion.

3. The antenna structure of claim 2, wherein:

a portion of the border frame between the first feed source and the first gap defines a first radiating section;

a portion of the border frame between the first feed source and the second gap defines a second radiating section;

the second feed source is electrically coupled to the second radiating portion;

when the first feed source supplies the electric current, the electric current from the first feed source flows through the first radiating section to excite a first resonant mode and generate a radiating signal in a first frequency band;

the electric current from the first feed source flows through the second radiating section and is electrically coupled to the third radiating portion through the second gap to excite a second resonant mode and generate a radiation signal in a second frequency band;

when the second feed source supplies the electric current, the electric current from the second feed source flows through the second radiating portion to excite a third resonant mode and generate a radiation signal in a third frequency band.

4. The antenna structure of claim 3, wherein:

the first resonant mode is a Long Term Evolution Advanced (LTE-A) low-frequency mode;

the second resonant mode is an LTE-A mid-frequency mode;

the third resonant mode is an LTE-A high-frequency mode.

5. The antenna structure of claim 3, wherein:

one of the two extending portions is electrically coupled to an end of the second radiating section adjacent to the second gap; and a second one of the two extending portions is electrically coupled to an end of the third radiating portion adjacent to the second gap.

6. The antenna structure of claim 3, wherein:

the second feed source is electrically coupled to the third radiating portion;

when the first feed source supplies the electric current, the electric current from the first feed source flows through the first radiating portion to excite a first resonant mode and generate a radiation signal in a first frequency band;

the electric current from the first feed source flows through the first radiating portion and is electrically coupled to the second radiating portion through the first gap to excite a second resonant mode and generate a radiation signal in a second frequency band;

the electric current from the first feed source flows through the third radiating portion to excite a third resonant mode and generate a radiation signal in a third frequency band.

7. The antenna structure of claim 6, wherein:

the first resonant mode is an LTE-A low-frequency mode;

the second resonant mode is an LTE-A mid-frequency mode; and the third resonant mode is an LTE-A high-frequency mode.

8. The antenna structure of claim 6, wherein:

one of the two extending portions is electrically coupled to an end of the first radiating section adjacent to the first gap; and a second one of the two extending portions is electrically coupled to an end of the second radiating portion adjacent to the first gap.

9. The antenna structure of claim 2, wherein:

a portion of the border frame between the first feed source and the first gap defines a first radiating section;

a portion of the border frame between the first feed source and the second gap defines a second radiating section;

the second feed source is electrically coupled to the third radiating portion;

when the first feed source supplies the electric current, the electric current from the first feed source flows through the first radiating section toward the first gap to excite a first resonant mode and generate a radiation signal in a first frequency band;

the electric current from the first feed source flows through the second radiating section toward the second gap to excite a second resonant mode and generate a radiation signal in a second frequency band;

the electric current from the first feed source flows through the first radiating section and is electrically coupled to the second radiating portion through the first gap to excite a third resonant mode and generate a radiation signal in a third frequency band;

when the second feed source supplies the electric current, the electric current from the second feed source flows through the third radiating portion to excite a fourth resonant mode and generate a signal in a fourth frequency band.

10. The antenna structure of claim 9, wherein:

the first resonant mode is an LTE-A low-frequency mode;

the second resonant mode is an LTE-A mid-frequency mode;

the third resonant mode is an LTE-A high-frequency mode; and the fourth resonant mode is an LTE-A mid-high-frequency mode.

11. The antenna structure of claim 9, wherein:

a first antenna comprises the first feed source, the first radiating portion, and the second radiating portion, the first antenna being adapted to excite a resonant mode in an LTE-A low, middle, and high-frequency mode;

a second antenna comprises the second feed source and the third radiating portion, the second antenna being adapted to excite a resonant mode in an LTE-A mid-high-frequency mode; and the first antenna and the second antenna cooperative form a multi-input and multi-output antenna structure.

12. The antenna structure of claim 1, wherein the middle frame and the border frame are integrally formed.

13. The antenna structure of claim 3 further comprising a switching circuit comprising a switching unit and at least one switching component, wherein:

the switching unit is electrically coupled to the first radiating section;

the at least one switching component is electrically coupled in parallel;

one end of each of the at least one switching component is electrically coupled to the switching unit, and another end of each of the at least one switching component is electrically coupled to ground;

the switching unit switches a connection between the first radiating section and the at least one switching component to adjust a frequency of the first frequency band.

14. The antenna structure of claim 6 further comprising a switching circuit comprising a switching unit and at least one switching component, wherein:

the switching unit is electrically coupled to the first radiating section;

the at least one switching component is electrically coupled in parallel;

one end of each of the at least one switching component is electrically coupled to the switching unit, and another end of each of the at least one switching component is electrically coupled to ground;

the switching unit switches a connection between the first radiating section and the at least one switching component to adjust a frequency of the first frequency band.

15. The antenna structure of claim 9 further comprising a switching circuit comprising a switching unit and at least one switching component, wherein:

the switching unit is electrically coupled to the first radiating section;

the at least one switching component is electrically coupled in parallel;

one end of each of the at least one switching component is electrically coupled to the switching unit, and another end of each of the at least one switching component is electrically coupled to ground;

the switching unit switches a connection between the first radiating section and the at least one switching component to adjust a frequency of the first frequency band.

16. A wireless communication device comprising an antenna structure comprising:

a housing comprising a middle frame and a border frame, wherein the middle frame and the border frame are made of metal, the border frame is mounted around a periphery of the middle frame, the border frame comprises a slot, a first gap, and a second gap, the slot is in an inner side of the border frame, a width of a first portion of the border frame defining the slot is less than a width of a second portion of the border frame not defining the slot, the first gap and the second gap are in the border frame, the slot, the first gap, and the second gap divide the border frame into a first radiating portion, a second radiating portion, and a third radiating portion, the first radiating portion is insulated from the middle frame by the slot;

a first feed source electrically coupled to the first radiating portion and adapted to provide an electric current to the first radiating portion;

a second feed source electrically coupled to one of the second radiating portion and the third radiating portion, another one of the second radiating portion and the third radiating portion being electrically coupled to the first radiating portion; and two extending portions, wherein the two extending portions face to each other, the two extending portions are electrically coupled to two radiating portions adjacent to one of the first gap and the second gap; wherein:

a thickness of the border frame is greater than or equal to twice a width of the first gap or twice a width of the second gap; and a width of the slot is less than or equal to half the width of the first gap or half the width of the second gap.

17. The wireless communication device of claim 16, wherein:

the border frame comprises an end portion, a first side portion, and a second side portion;

the first side portion and the second side portion are respectively coupled to opposite ends of the end portion;

the first gap is in the end portion adjacent the first side portion, and the second gap is in the end portion adjacent the second side portion;

the slot is in an inner side of the end portion and extends toward the first side portion and the second side portion;

the first radiating portion is defined in a portion of the border frame between the first gap and the second gap;

the second radiating portion is defined in a portion of the border frame between the first gap and an endpoint of the first side portion;

the third radiating portion is defined in a portion of the border frame between the second gap and an endpoint of the second side portion.

18. The wireless communication device of claim 17, wherein:

a portion of the border frame between the first feed source and the first gap defines a first radiating section;

a portion of the border frame between the first feed source and the second gap defines a second radiating section;

the second feed source is electrically coupled to the second radiating portion;

when the first feed source supplies the electric current, the electric current from the first feed source flows through the first radiating section to excite a first resonant mode and generate a radiating signal in a first frequency band;

the electric current from the first feed source flows through the second radiating section and is electrically coupled to the third radiating portion through the second gap to excite a second resonant mode and generate a radiation signal in a second frequency band;

when the second feed source supplies the electric current, the electric current from the second feed source flows through the second radiating portion to excite a third resonant mode and generate a radiation signal in a third frequency band.

19. The wireless communication device of claim 17, wherein:

the second feed source is electrically coupled to the third radiating portion;

when the first feed source supplies the electric current, the electric current from the first feed source flows through the first radiating portion to excite a first resonant mode and generate a radiation signal in a first frequency band;

the electric current from the first feed source flows through the first radiating portion and is electrically coupled to the second radiating portion through the first gap to excite a second resonant mode and generate a radiation signal in a second frequency band;

the electric current from the first feed source flows through the third radiating portion to excite a third resonant mode and generate a radiation signal in a third frequency band.

20. The wireless communication device of claim 17, wherein:

a portion of the border frame between the first feed source and the first gap defines a first radiating section;

a portion of the border frame between the first feed source and the second gap defines a second radiating section;

the second feed source is electrically coupled to the third radiating portion;

when the first feed source supplies the electric current, the electric current from the first feed source flows through the first radiating section toward the first gap to excite a first resonant mode and generate a radiation signal in a first frequency band;

the electric current from the first feed source flows through the second radiating section toward the second gap to excite a second resonant mode and generate a radiation signal in a second frequency band;

the electric current from the first feed source flows through the first radiating section and is electrically coupled to the second radiating portion through the first gap to excite a third resonant mode and generate a radiation signal in a third frequency band;

when the second feed source supplies the electric current, the electric current from the second feed source flows through the third radiating portion to excite a fourth resonant mode and generate a signal in a fourth frequency band.

* * * * *